United States Patent [19]

Jürgens et al.

[11] Patent Number: 5,029,653

[45] Date of Patent: Jul. 9, 1991

[54] METHOD FOR DIRECTIONAL CORING

[75] Inventors: Rainer Jürgens, Celle, Fed. Rep. of Germany; Johann van Es, Sherwood Park, Canada

[73] Assignee: Baker Hughes Incorporated, Houston, Tex.

[21] Appl. No.: 472,885

[22] Filed: Jan. 31, 1990

[30] Foreign Application Priority Data

Feb. 1, 1989 [DE] Fed. Rep. of Germany ..... 3902869

[51] Int. Cl.[5] ..... E21B 49/02; E21B 7/06

[52] U.S. Cl. ..... 175/58; 175/61

[58] Field of Search ..... 175/58, 61, 73, 75, 175/77–80, 82, 257, 258, 386, 387, 403

[56] References Cited

U.S. PATENT DOCUMENTS

| | | | |
|---|---|---|---|
| 2,571,644 | 10/1951 | Zublin | 175/58 X |
| 2,852,230 | 9/1958 | Garrison | 175/82 X |
| 3,169,589 | 2/1965 | Bodine, Jr. | 175/58 |
| 3,353,612 | 11/1967 | Bannister | 175/58 X |
| 4,248,313 | 2/1981 | Bonca | 175/403 X |
| 4,518,050 | 5/1985 | Sollie et al. | 73/864.45 X |
| 4,875,531 | 10/1989 | Biehl et al. | 175/58 |

FOREIGN PATENT DOCUMENTS

| | | |
|---|---|---|
| 3701914 | 5/1988 | Fed. Rep. of Germany . |
| 8810844 | 12/1988 | Fed. Rep. of Germany . |

*Primary Examiner*—Hoang C. Dang

*Attorney, Agent, or Firm*—Michael Polacek

[57] ABSTRACT

The present invention comprises a novel method and apparatus for sinking drill holes in underground rock formations while generating drill cores as rock samples. More particularly, the present invention discloses a method and apparatus which allows for an expanded analysis of ground formations over a larger area through the extraction of drill cores as rock samples. The method and apparatus herein disclosed allowed one to drill a number of core shaft sections from the base of a main shaft section in various directions in order to obtain a number of sample cores.

7 Claims, 3 Drawing Sheets

METHOD FOR DIRECTIONAL CORING

BACKGROUND OF THE INVENTION

The present invention pertains to a novel method and apparatus for sinking drill holes in underground rock formations while generating drill cores as rock samples.

The known methods of this type, as described in U.S. Pat. No. 4,518,050 and German Patent DE-C 37 01 914, are intended to optimize the core sample. In these methods, the main drill hole sections follow in the direction of the pilot hole sections and the core shaft section is drilled through the main drilling tool which includes a rotary drill bit corresponding to the rated diameter of the main drilling tool. Once the main drilling tool reaches the base of the core shaft section in the course of this drilling, it is stopped and a nearby core shaft section is drilled for core sampling. The length of the core shaft section is governed by the potentials of the particular tool design and can be quite considerable such as in the design disclosed in German Patent DE-U-88 10 844.

In the known methods, the core drilling unit in the outer housing of the core drilling tool is guided coaxially by a non-rotating guide device. When a core shaft section is drilled, the core tube of the core drilling unit exits coaxially from the outer housing. The outer housing of the core drilling tool thus controls the direction of the advance of the core tube.

SUMMARY OF THE INVENTION

The present invention discloses a method and apparatus which allows for an expanded analysis of ground formations over a larger area through the extraction of drill cores as rock samples.

The present invention discloses a directional core drilling method and a directional core drilling tool which can specify and direct a predetermined core drilling direction which differs from the usually coaxial run of conventional core drilling. The method and apparatus herein disclosed can establish a profile of drill shafts by digressing from the direction of the main drill hole. By using the present method and apparatus, it is also possible to drill from the base of a main shaft section in various directions to create core shaft sections and thus to obtain a number of cores.

BRIEF DESCRIPTION OF THE DRAWINGS

Various designs of the present invention are illustrated in the following figures.

DETAILED DESCRIPTION OF THE PREFERRED EMBODIMENTS

Figure 1:
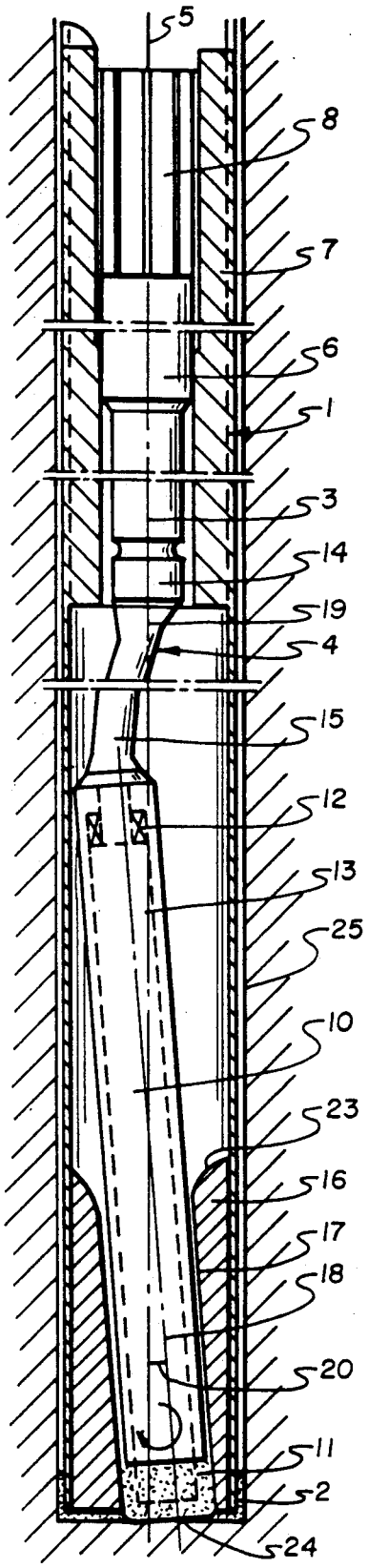
FIG. 1 is a partial vertical cross-section view through the outer housing of a core drilling tool disclosed by the present invention when placed on the base of a main shaft section with the core drilling unit in position for starting core drilling.
Figure 2:
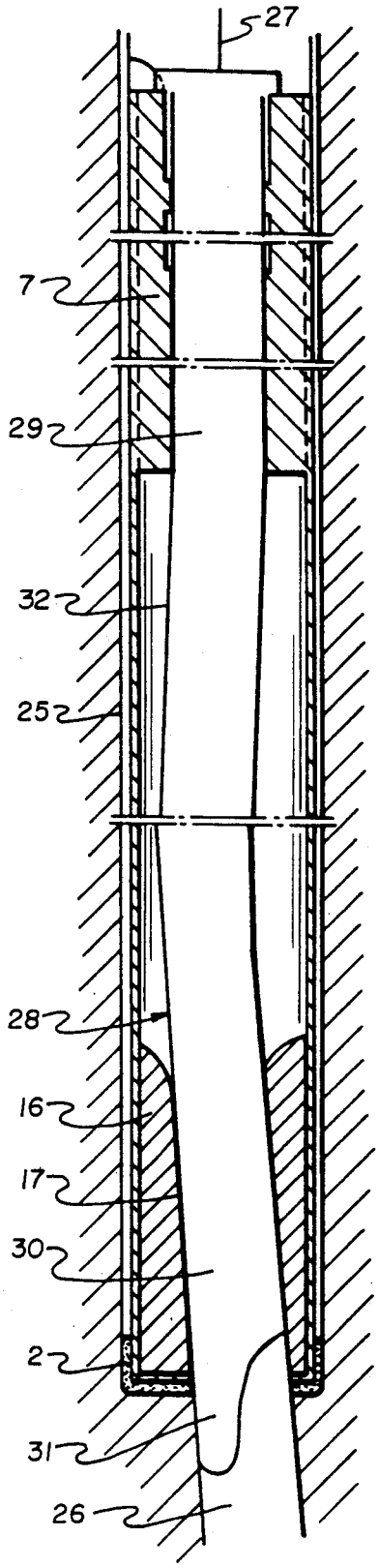
FIG. 2 is a cross-section view similar to FIG. 1 where the core drilling tool includes a guide spindle instead of a core drilling unit.

The core drilling tool illustrated in FIGS. 1 and 2 is comprised of an outer housing 1 whose upper end (not illustrated) is connectable with a drill string and which has on its lower end a drill bit 2. The core drilling tool is further comprised of a core drilling unit 4 provided with a deep hole motor 3 and braced in outer housing 1. The unit 4 can be raised or lowered as a whole via a cable 5 and has an upper part 6 which can shift axially and which is secured against rotating in the outer housing 1 by means of a non-rotating guide device 7 formed by an axially multi-wedged shaped part. The upper part 6 of the core drilling unit 4 is provided with reaction surfaces 8 which produce an axially downward directed propulsion force. For a detailed description of this type of core drilling tool refer to German Patent DE-C-37 01 914.

The core drilling unit 4 is further comprised of a lower portion having a core tube 10 driven by the deep hole motor 3 and including a core drilling bit 11 located on its lower end and a rotary-seated inner tube 13 mounted on a bearing 12 and used to hold the drilling core. At its upper end, the core tube 10 is connected with the deep hole motor 3 drive shaft 14 via a tubular, flexible connector 15. An articulated shaft or a similar connector could also be used.

Figure 4:
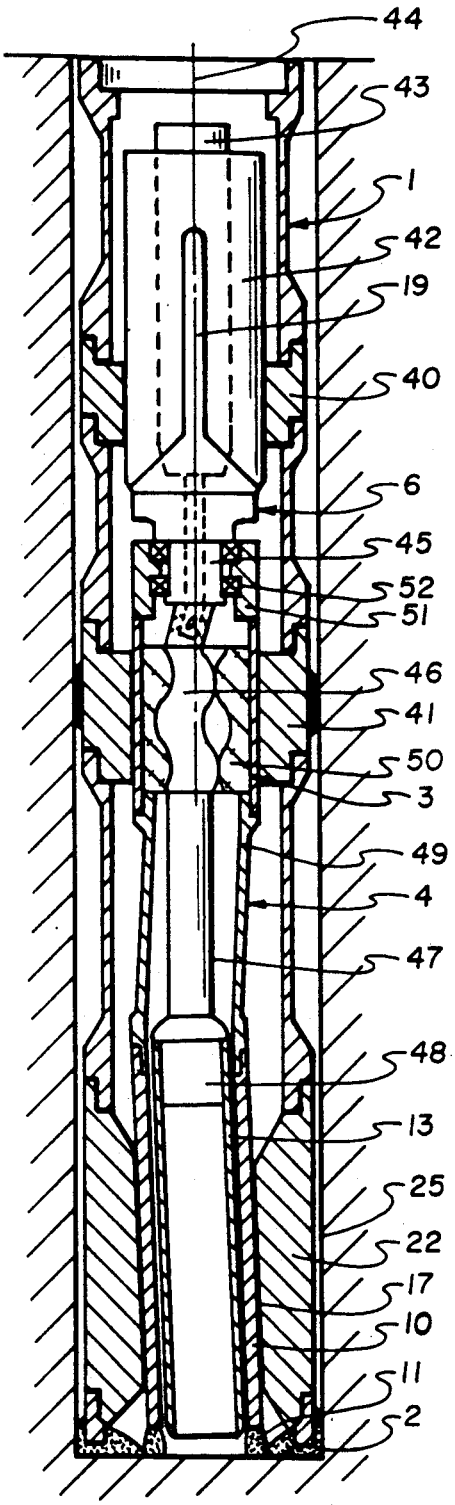
FIG. 4 is a cross-section view similar to FIG. 1 showing a modified design of a core drilling tool as disclosed by the present invention.
Figure 3:
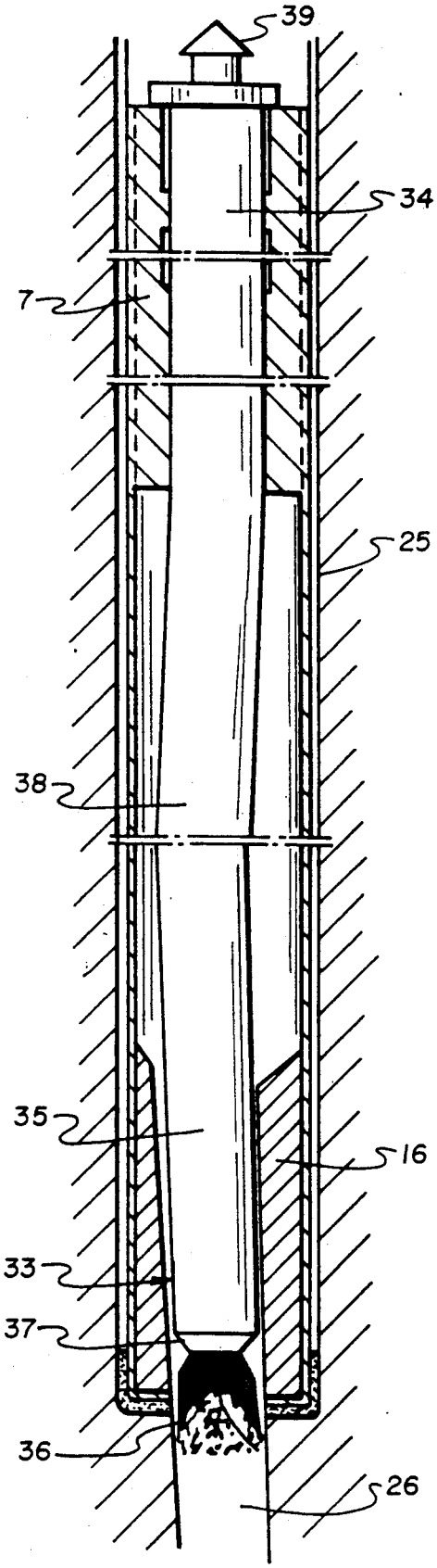
FIG. 3 is a cross-section view similar to FIG. 1 showing the core drilling tool with a finishing drill bit instead of a core drilling unit.
Figure 5:
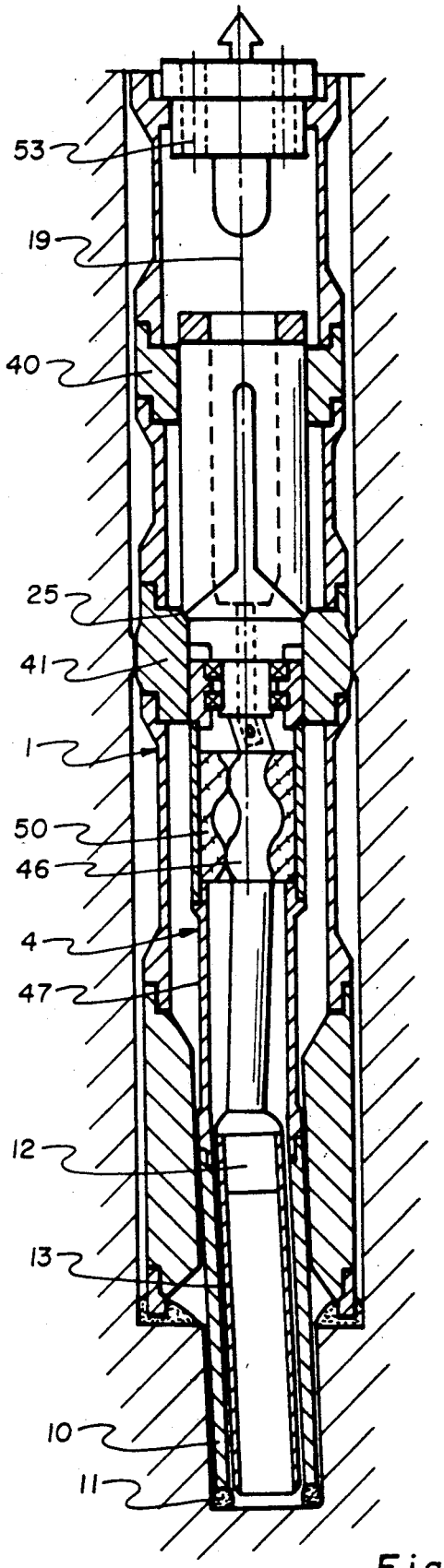
FIG. 5 is a cross-section view of the core drilling tool of FIG. 4 while it is post-drilling a main shaft section under guidance by the core tube of the core drilling unit located in the pre-drilled core shaft section.

A guide element 16 with guide surface 17 for core tube 10 is provided in the lower region of outer housing 1. This element 16 defines a guide axis 18 which is at an acute angle 20 with the main axis 19 of the outer shaft 1. The guide element 16, as shown in FIGS. 1 to 3, is designed as an outside cylindrical tube which is non-rotatably seated in outer housing 1 as a secured unit, e.g., by a fitting spring (not illustrated). The guide element could also be of an outside cylindrical tubular design as shown in FIGS. 4 and 5 and form a component of the wall of the outer housing 1.

The guide element 16 can be designed as hoistable unit which is also lowerable into outer housing 1 and secured against rotating only in the operating position in outer housing 1. Therefore, it is possible to have differing guide orientations relative to the outer housing 1 and to replace a guide element by one with a differing angular alignment of the guide axis 18, which alignment, if need be, could also run parallel to the main axis 19 of the outer housing 1.

The guide element 16 and the non-rotating guide device 7 for the upper part 6 of the core drilling unit 4 can be combined into a hoistable unit which is also lowerable into the operating position of outer housing 1, e.g., via axial distancing pieces (not illustrated). As a rule, a guide element 16 designed as an installed unit in outer housing 1 will be secured against rotating and against vertical shifting. The guide element 16 or 22 includes a sloped cylindrical guide surface 17 formed by a solid, slope-mounted guide hole which can be provided with an upper, funnel-like inlet 23.

The core drill unit 4 is shown in its starting position in FIG. 1 wherein the core tube 10 extends into the guide hole of guide element 16 and assumes a correspondingly slanted direction. For drilling a core shaft section proceeding from the position shown in FIG. 1, the core drilling unit 4 is lowered along the non-rotating guide device 7 in outer housing 1 and drills out a core shaft section 26 emanating from the base 24 of a main shaft section. The section 26 has a direction corresponding to the angle 20 with respect to the alignment of the outer housing 1 of the core drilling tool. Several core shaft sections 26 can be drilled in differing directions to scout out the formation environ from the same shaft base 24 merely by changing the position of the outer housing 1.

Following the drilling of a core shaft section 26 to obtain a core in the inside tube 13, the core drilling unit 4 can be lifted by cable 5 connected to a catch unit (not shown) and the core removed above ground. For after-drilling the main shaft section 25 along the pre-drilled core shaft section 26, a guide spindle 28 can be placed in the outer housing as shown in FIG. 2. This spindle can be raised and lowered into a working position in outer housing 1. The spindle has an upper support unit 29 employed in the non-rotating guide device 7 of outer housing 1 and a spindle section 30 with a pilot peak 31 protruding downward through the guide element 16. Both parts 29 and 30 are connected by a flexible intermediate connector 32 which allows the spindle 30 to enter the guide element 16 and ensures a slanted alignment in it.

After insertion of the guide spindle 28 into its operating position wherein it is secured against rotation, as shown in FIG. 2, the outer housing 1 is rotated along with the main drill bit 2 from above ground via the drill string. A main shaft section 25 is then drilled along the pre-bored core shaft section 26 whereby the core shaft section 26 is converted into the next main shaft section 25. As soon as the main shaft section 25 is finish-drilled, the guide spindle 28 is withdrawn and a core drilling unit 4 is placed into outer housing 1. A new core shaft section 26 can then be drilled. Once the desired alignment of axis 18 of the guide element 16 or 22 is attained, the direction of the next drilled core shaft section can be specified by a twist of the outer housing 1.

Instead of a guide spindle 28, a hoistable tool 33 as shown in FIG. 3 can be used for the after-drilling of a main shaft section 25. This finishing drill tool 33 can be lowered into an operating position in the outer housing 1. The tool 33 has an upper, tubular support housing section 34 which meshes in its operating position with the non-rotating guide device 7 of the outer housing 1 and which section 34 also includes a deep hole motor 3. The tool 33 further includes a lower bearing housing 35 which meshes into guide element 16 and on which a bit shaft 37 is seated which includes on its end and protruding from the bearing housing section 35 and from the guide element 16 and the outer housing 1 a finishing drill bit 36. A flexible intermediate housing section 38 between the support housing section 34 and the bearing housing section 35 allows the bearing housing section 35 to assume the slanted alignment of guide element 16 as illustrated in FIG. 3. The finishing drill tool 33 is manipulated via a catch mechanism 39 at the upper end of support section 34 and it can include any suitable finishing drill bit 36. The bit 36 is laterally shifted into the pre-drilled core shaft section 26 thereby allowing for a re-drilling of the core shaft section 26.

The design shown in FIGS. 4 and 5 basically corresponds to that shown in FIG. 1 except that the guide element 22 is designed as a tubular component of the wall of the outer housing 1. Furthermore, instead of a single non-rotating guide device 7, a two-part design is provided as shown whereby the outer housing 1 includes a non-rotating section 40 and a guide section 41. The upper section 6 of the core drilling unit 4 is comprised of an upwardly open, tubular housing 42 comprised of anti-magnetic material. This housing 42, when in its operating position, meshes with the non-rotating section 40 and is designed as a holder for a removable orientation-control unit 43. The orientation-control unit 43 can be raised and lowered by a separate cable 44. In its operating position, the unit 43 assumes a non-rotating alignment within the housing 42, for example by means of a fitting spring (not shown). This alignment and information about the alignment of the guide axis of the guide element 22 of the outer housing 1 can be queried from above ground.

In conjunction with this information, the outer housing 1 can be twisted from above ground via the drill string so that the alignment of the guide axis is in the direction corresponding to the direction of the core shaft to be drilled. The housing 42 of the upper part 6 of the core drilling unit 4 is then moved down in carrier segments which consist of bearing section 45, an internal stator 46 for the deep hole motor 3, and a flexible connector 47 on whose lower trunnion 48 the inside tube 13 of core drilling unit 4 is attached. The core tube 10 is connected via a tubular, flexible intermediate pipe section 49 to the rotor 50 of the deep hole motor 3 which is rotatably-seated through an upper tubular extension 51 via bearing device 52 on bearing piece 45.

The directional drilling method performed with the core drilling tool as shown in FIGS. 4 and 5 corresponds to that described in connection with the core drilling tool shown in FIGS. 1 to 3. After the outer housing 1 has been put into the appropriate alignment corresponding to the direction of the core shaft section 26 to be drilled, through turning and locking from above ground, the orientation-control unit 43 is lifted out and the core drilling is performed. For after-drilling a main shaft section 25, the outer housing 1 is driven downward with its main drill bit 2 under the force of the drill string with the core drill unit 4 serving as a guide agent.

As shown in FIG. 5, in order to keep the core drilling bit 11 from being accidentally over-drilled by the main drill bit 2, a separate hoisting valve unit 53 can be placed in the outer housing 1. The valve can be lowered into an operating position and, once the outer housing 1 moves downward relative to housing 42 of the upper section 6, the core drilling unit 4 meshes with the valve thereby blocking the drill mud flow through the housing 42. A pressure increase then occurs which is measured above ground and can be read to indicate that the main drilling tool has reached a specified distance from the core drilling tool.

In the foregoing specification, the present invention has been described with reference to specific exemplary embodiments thereof. It will be evident, however, that various modifications and changes may be made thereunto without departing from the broader spirit and scope of the invention as set forth in the appended claims The specification and drawings included here are, accordingly, to be regarded in an illustrative rather than in a restrictive sense.

What is claimed:

1. A method of sinking drill holes in underground rock formations while generating drilled cores as rock samples comprised of the steps of drilling a main drill hole section, said main hole section including a base of main hole diameter, with a main drilling tool and subsequently drilling one or more core drill hole sections with a core drilling tool, with at least one of said one or more core hole sections emanating from the base of the main hole section in a specified direction which is non-coaxial to said main hole section and having a reduced core hole diameter as compared to the main hole diameter, followed by drilling a further main hole section in substantially the same direction as one of said one or more core hole sections.

2. The method of claim 1 wherein a plurality of core hole sections are drilled, said core hole sections all emanating from the base of the main hole section in differing specified directions.

3. The method of claim 1 or 2 wherein the direction of each of said one or more core drill hole sections is specified by a guide element disposed within the main drilling tool.

4. The method of claim 1 wherein the further main hole section following a direction-drilled core shaft section is drilled in and along one of said one or more direction-drilled core shaft sections.

5. The method of claim 4 wherein the main drilling tool is guided along the direction-drilled core shaft section by a guide spindle.

6. The method of claim 4 wherein a finishing drill bit is used to guide the main drill tool along the direction-drilled core shaft section, said bit moving in advance of the main drilling tool.

7. The method of claim 1 wherein the core drilling tool includes a core tube which is allowed to remain within the core hole section in order to guide the main drilling tool along the core hole section.

* * * * *